US005360706A

United States Patent [19]

Anderson et al.

[11] Patent Number: 5,360,706

[45] Date of Patent: Nov. 1, 1994

[54] IMAGING ELEMENT

[75] Inventors: Charles C. Anderson, Penfield; Gerald M. Leszyk, Spencerport; Kenneth L. Tingler, Rochester, all of N.Y.

[73] Assignee: Eastman Kodak Company, Rochester, N.Y.

[21] Appl. No.: 156,594

[22] Filed: Nov. 23, 1993

[51] Int. Cl.[5] ..... G03C 1/85

[52] U.S. Cl. ..... 430/529; 430/530

[58] Field of Search ..... 430/527, 529, 530

[56] References Cited

U.S. PATENT DOCUMENTS

| | | |
|---|---|---|
| 3,018,272 | 1/1962 | Griffing et al. . |
| 3,033,679 | 5/1962 | Laakso et al. . |
| 3,437,484 | 4/1969 | Nadeau . |
| 3,525,621 | 8/1970 | Miller . |
| 3,630,740 | 12/1971 | Joseph et al. . |
| 3,681,070 | 8/1972 | Timmerman et al. . |
| 3,929,489 | 12/1975 | Arcesi et al. . |
| 4,203,769 | 5/1980 | Guestaux . |
| 4,307,174 | 12/1981 | Noonan et al. . |
| 4,394,442 | 7/1983 | Miller . |
| 4,419,437 | 12/1983 | Noonan et al. . |
| 4,478,907 | 10/1984 | Van Gossum et al. . |
| 4,542,095 | 9/1985 | Steklenski et al. . |
| 4,704,309 | 11/1987 | Coney et al. . |
| 4,738,785 | 4/1988 | Langston et al. . |
| 4,847,316 | 7/1989 | Schick et al. . |
| 4,883,706 | 11/1989 | Grosjean . |
| 4,883,714 | 11/1989 | Stockl et al. . |
| 4,916,011 | 4/1990 | Miller . |
| 5,066,451 | 4/1991 | Anderson et al. . |
| 5,221,598 | 6/1993 | Anderson et al. . |

FOREIGN PATENT DOCUMENTS

| | | |
|---|---|---|
| 0247648A1 | 12/1087 | European Pat. Off. . |
| 0247648B1 | 8/1989 | European Pat. Off. . |

OTHER PUBLICATIONS

*RD 24108*, Disclosed Anonymously, May 1984, pp. 189–193.

*Product Licensing Index*, vol. 92, Dec. 1971, Publication 9232, pp. 107–110.

*Primary Examiner*—Jack P. Brammer

*Attorney, Agent, or Firm*—Robert A. Gerlach

[57] ABSTRACT

Imaging elements comprising a support, at least one imaging layer and an antistat layer, said antistat layer comprising vanadium pentoxide in a binder, said binder being a polyesteranionomer and coating compositions for forming such antistat layers.

9 Claims, No Drawings

IMAGING ELEMENT

BACKGROUND OF THE INVENTION

1. Field of the Invention

This invention relates to coating compositions for applying antistatic layers to a support and to photographic imaging elements comprising an imaging layer and a support material containing an antistatic layer comprising a vanadium pentoxide colloidal gel dispersed in a binder. The invention is applicable to conventional photographic imaging elements as well as thermally processable imaging elements including thermographic and photothermographic imaging elements.

2. Description of Related Art

The problem of controlling static charge is well known. Static charging may occur due to various factors in the manufacture, finishing, and use of imaging elements, especially, photographic elements. The accumulation of static charges can result in fog patterns in photographic emulsions, various coating imperfections such as mottle patterns and repellency spots, dirt and dust attraction which may result in the formation of "pinholes" in processed films, and a variety of handling and conveyance problems.

To overcome the problem of accumulation of static charges, it is conventional practice to provide an antistatic layer in photographic elements. Many antistatic agents have been utilized for this purpose.

It is known to prepare an antistatic layer from a composition comprising a vanadium pentoxide colloidal gel as described, for example, in U.S. Pat. No. 4,203,769 issued May 20, 1980, U.S. Pat. No. 5,006,451 issued Apr. 9, 1991, and U.S. Pat. No. 5,221,598 issued Jun. 22, 1993. Antistatic layers containing vanadium pentoxide provide excellent protection against static and are highly advantageous in that they have excellent transparency and their performance is not significantly dependent on humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10000 angstroms long. Low surface resistivities can be obtained with very low vanadium pentoxide coverages as a result of this high aspect ratio morphology.

Typically, the vanadium pentoxide is coated in a polymeric binder to improve adhesion to adjacent layers and to improve the durability of the antistatic layer. Several polymer binders have been disclosed in the above-mentioned U.S. Patents, for example, interpolymers of vinylidene chloride for aqueous-based antistat coating formulations. As a result of the very low coverages required, the antistat coating formulations typically comprise concentrations for the vanadium pentoxide gel of about 0.1 weight % or less, typically less than 0.05 weight %. Such low concentrations result in coating formulations which are prone to instability and flocculation of the vanadium pentoxide gel. This creates serious difficulties in accumulation of flocculated vanadium pentoxide plugging) in coating solution delivery lines, filters, and coating hoppers. The addition of surfactant no the coating formulation to stabilize the vanadium pentoxide may help alleviate the problems of flocculation, but, this typically results in antistatic layers which comprise high levels of surfactant in the dried film. This is undesirable when the antistatic layer is to be overcoated with other layers such as protective overcoats or hydrophilic colloid layers such as gelatin-containing subbing layers, photographic emulsions, or curl control layers. The high concentration of surfactant in the dried antistatic layer can seriously affect the coatability and adherence of these subsequently applied layers.

Thus, it is highly desirable to provide an antistatic layer comprising colloidal vanadium pentoxide which is applied from a coating formulation with improved stability and has improved adherence to underlying and overlying layers. It is toward such objectives that the current invention is directed.

SUMMARY OF THE INVENTION

The invention provides an aqueous coating composition for applying an antistat layer to a support comprising a colloidal gel of vanadium pentoxide dispersed in a water dispersible anionic polyesterionomer binder. The polyesterionomer binder provides improved solution stability and adherence to subsequently applied layers. Further, the invention contemplates antistat layers of vanadium pentoxide in an anionic polyesterionomer binder and to imaging elements having such antistat layers.

DETAILED DESCRIPTION OF THE INVENTION

Imaging elements which can be protected against static by the practice of the invention can vary greatly in the structure and composition of the support, the number and composition of the image-forming layers, the kinds of auxiliary layers present, the materials used to form the various layers, and so on. While the invention is primarily applicable to photographic elements, particularly silver halide photographic elements, it is also applicable to thermally processable imaging elements, including thermographic and photothermographic imaging elements. Also, for the purpose of describing the invention and for simplicity of expression, photographic elements will be primarily referred to throughout this specification; however, it is to be understood that the invention also applies to other forms of imaging elements.

Photographic elements of the invention can be prepared on any suitable opaque or transparent photographic support including films of various kinds of glasses such as soda glass, potash glass, borosilicate glass, quartz glass and the like; paper, baryta coated paper, paper coated with alpha olefin polymers, synthetic paper; polystyrene, ceramics, metals, foils; synthetic high molecular weight film materials such as polyalkyl acrylates or methacrylates, polystyrene, polyamides such as nylon, films of semisynthetic high molecular weight materials such as cellulose nitrate, cellulose acetate, cellulose acetate butyrate, and the like; homo and copolymers of vinyl chloride, poly(vinylacetal), polycarbonates, homo and copolymers of olefins such as polyethylene and polypropylene, and the like.

Polyester films are particularly advantageous because they provide excellent strength and dimensional stability, Such film supports are well known, widely used, and typically prepared from high molecular weight polyesters prepared by condensing a dihydric alcohol with a dibasic saturated fatty carboxylic acid or derivative thereof.

Suitable dihydric alcohols for use in preparing such polyesters are well known in the art and include any glycol wherein the hydroxyl groups are on the terminal carbon atom and contain from two to twelve carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for preparing polyesters include those containing from two to sixteen carbon atoms such as adipic acid, sebacic acid, terephthalic acid, isophthalic acid, 2,5-,2,7-, and 2,6-naphthalene dicarboxylic acid and the like. Alkyl esters of acids such as those listed above can also be employed. Other alcohols and acids as well as polyesters prepared therefrom and the preparation of the polyesters are described in U.S. Pat. Nos. 2,720,503 and 2,901,466 which are hereby incorporated herein by reference. Poly(ethylene terephthalate) and poly(ethylene naphthalate) are preferred.

Support thicknesses ranging from about 0.05 to about 0.25 millimeter, preferably 2 to 10 mil (0.002–0.010 inch) can be employed with very satisfactory results.

Generally, polyester film supports are prepared by melt extruding the polyester through a slit die, quenching to the amorphous state, orienting by transverse and longitudinal stretching, and heat setting under dimensional restraint. The polyester film can also be subjected to a heat relaxation treatment to improve dimensional stability and surface smoothness.

The support employed will typically contain an undercoat or primer (polymeric subbing) layer between the support and the antistatic layer. Subbing layers used to promote the adhesion of coating compositions to the support are well known and any such suitable material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers and the like. These and other suitable compositions are described, for example, in U.S. Pat. Nos. 2,627,088; 2,698,240; 2,943,937; 3,143,421; 3,201,249; 3,271,178; 3,443,950; 3,501,301 and the like which are hereby incorporated by reference. The polymeric subbing layer is usually overcoated with a second subbing layer comprised of gelatin, typically referred to as a Gel sub.

The antistatic layer of this invention comprises a colloidal gel of vanadium pentoxide as the conductive material. The use of vanadium pentoxide in antistatic layers is described in Guestaux, U.S. Pat. No. 4,203,769 which is incorporated herein by reference. The antistatic layer is prepared by coating an aqueous colloidal solution of vanadium pentoxide and a water dispersible anionic polyesterionomer binder. Preferably, the vanadium pentoxide is doped with silver. Typically the dried coating weight of the vanadium pentoxide antistatic material is about 0.5 to 30 mg/m$^2$. The weight ratio of polyester binder to vanadium pentoxide can range from about 1:5 to 200:1, but, preferably 1:1 to 10:1. The antistatic coating formulation may also contain a wetting aid to improve coatability. The coating may be applied onto the film support using coating methods well known in the art such as hopper coating, skim pan/air knife, gravure coating, and the like.

The water dispersible polyesterionomer binder described herein provides improved stability of he antistatic coating formulation and adhesion to adjacent layers. The term anionic polyesterionomer or polyesteranionomer refers to polyesters that contain at least one anionic moiety. Such anionic moieties function to make the polymer water dispersible.

The anionic polyesterionomer or polyesteranionomer binders in accordance with this invention include those polyesters having carboxylic acid groups, metal salts of carboxylic acids, sulfonic acid groups and metal salts of sulfonic acids. The metal salts may be sodium, lithium or potassium salts. The polyesteranionomers are prepared by including in the preparation of the polyester a compound that will react to form a polymeric backbone but will also contain anionic groups. Such compounds include tricarboxylic acids such as 1,3,5 benzene tricarboxylic acid, 1,4,6 napthylene tricarboxylic acid, metal salts of tricarboxylic acids such as those having two carboxylic acid groups for esterification reaction and the third being a metal salt of a carboxylic acid group, such as, 2,6-dibenzoic acid-5-sodiocarboxylate, 5-sodiocarboxyisophthalic acid, 4-sodiocarboxy-2,7-naphthalenedicarboxylate, the corresponding lithium and potassium salts and the like; sulfonyl group containing dicarboxylic acids, such as, hydroxy sulfonylterephthalic acids, hydroxy sulfonylisophthalic acid, especially 5-sulfoisophthalic acid, 4-hydroxy sulfonyl-2,7-napthalene dicarboxylic acid, and the like; the corresponding alkali metal sulfodicarboxylic acids and the like.

Typically the anionic moiety is provided by some of the dicarboxylic acid repeat units, the remainder of the dicarboxylic acid repeat units are nonionic in nature. The anionic moiety prevents the flocculation of the colloidal vanadium pentoxide antistat. Preferably the anionic dicarboxylic acid contains a sulfonic acid group or its metal salt. Examples include the sodium, lithium, or potassium salt of sulfoterephthalic acid, sulfonaphthalene dicarboxylic acid, sulfophthalic acid, and sulfoisophthalic acid or their functional equivalent anhydride, diester, or diacid halide. Most preferably the ionic dicarboxylic acid repeat unit is provided by 5-sodiosulfoisophthalic acid or dimethyl 5-sodiosulfoisophthalate.

These polyesters are prepared by reacting one or more dicarboxylic acids or their functional equivalents such as anhydrides, diesters, or diacid halides with one or more diols in melt phase polycondensation techniques well known in the art (see for example, U.S. Pat. Nos. 3,018,272; 3,929,489; 4,307,174; 4,419,437). Examples of this class of polymers include, for example, Eastman AQ polyesterionomers, manufactured by Eastman Chemical Co.

The nonionic dicarboxylic acid repeat units are provided by dicarboxylic acids or their functional equivalents represented by the formula:

$$-\overset{\overset{\displaystyle O}{\|}}{C}-R-\overset{\overset{\displaystyle O}{\|}}{C}-$$

where R is an aromatic or aliphatic hydrocarbon or contains both aromatic and aliphatic hydrocarbons. Exemplary compounds include isophthalic acid, terephthalic acid, 2,5-,2,6-, or 2,7-naphthalene dicarboxylic acid, succinic acid, sebacic acid, adipic acid, azelaic acid, diphenyl dicarboxylic acid, cyclohexylene dicarboxylic acid and the like.

Suitable diols are represented by the formula: HO—R—OH, where R is aromatic or aliphatic or contains both aromatic and aliphatic hydrocarbons. Suitable diols include ethylene glycol, diethylene glycol, 1,4-cyclohexanedimethanol, 1,3-propanol diol, 1,4 butane diol, neopentyl glycol, and the like.

The polyesterionomer binders of the invention comprise from about 1 to about 25 mol %, based on the total moles of dicarboxylic acid repeat units, cf the ionic dicarboxylic acid repeat units. Preferably the polyesterionomers have a glass transition temperature ($T_g$) of about 0° to 100° C. More preferably, the $RT_g$ is about 20° to 80° C.

The antistatic layer of this invention can be overcoated with various types of protective overcoats (for example, cellulose esters, polyurethanes, polyesters, acrylate and/or methacrylate containing interpolymers), such as, those set forth in U.S. Pat. Nos. 5,006,451 and 5,221,598, both of which are incorporated herein by reference, gelatin subbing layers, silver halide emulsions, and gelatin curl control layers. Typical silver halide emulsions are taught in patents listed in Product Licensing Index, Vol. 92, December 1971, publication 9232, at page 107. The silver halide emulsions used in combination with the antistatic support of this invention can also contain other photographic compounds such as those taught in Product Licensing Index, op. cit., pages 107–110. Such compounds include development modifiers antifoggants and stabilizers, developing agents, hardeners, vehicles such as gelatin or polymeric binders, absorbing and filter dyes, color-forming couplers, coating aids, and others.

The vanadium pentoxide antistatic layer and the overcoat layer can be coated on a support at any suitable coverage with optimum coverage for each layer depending on the particular photographic product desired. Typically, the antistat layer is coated at a dry coverage of from about 1 to 50 milligrams per square meter. The overcoat layer is preferably coated from a coating formulation containing from about 0.5 to about 10 weight percent of polymer to give a dry coverage of from about 50 to about 3000 milligrams per square meter. The dry coverage of the overcoat layer is preferably from about 300 to 2000 milligrams per square meter.

Emulsions containing any suitable silver salt can be used to form the silver halide layers of the photographic elements of the invention. Such emulsions can be prepared using conventional techniques depending on desired end-use. Silver chloride, silver chlorobromide, silver bromide, silver bromoiodide silver chlorobromoiodide and the like can be used as the silver halide.

Any known protective colloid can be used individually or in combination with gelatin, a water soluble gelatin substitute, or derivative of either of them, in the preparation of the photosensitive emulsion. Examples include gelatin (lime processed or acid processed), gelatin derivatives produced by reacting gelatin with other high polymers, albumin and casein, cellulose derivatives such as hydroxyethyl cellulose and carboxymethyl cellulose, sugar derivatives such as agar, sodium alginate and starch derivatives, polymeric materials such as polyvinyl alcohol-hemiacetal, poly-N-vinyl pyrrolidone, polyacrylic acid, polyacrylamide, polyvinylimidazole, and the like. Other suitable gelatin derivatives are disclosed in U.S. Pat. Nos. 2,614,928; 2,763,639; 3,118,766; 3,132,945; 3,186,846; 3,312,553; 4,268,622; 4,059,448; 2,763,625; 2,831,767; 2,956,884; 3,879,205 and the like which are hereby incorporated herein by reference.

Known processes can be used to prepare the silver halide emulsion which can be coated by any suitable method. Coating methods include dip coating, curtain coating, roller coating, extrusion coating and the like as disclosed, for example, in U.S. Pat. Nos. 2,681,294; 4,059,448; 2,761,791; 2,941,898 and the like which are hereby incorporated herein by reference. Two or more layers can be coated at the same time, if desired.

The silver halide emulsions can also contain any suitable compounds to increase speed, antifog, stabilize, harden, matte, lubricate, plasticize, brighten, sensitize, aid in coating, absorb UV, and so On.

Some suitable hardeners are disclosed, for example, in U.S. Pat. Nos. 1,870,354; 3,380,829; 3,047,394; 3,091,537; 3,325,287; 2,080,019; 2,726,162; 3,725,925; 3,255,000; 3,321,313 and 3,057,723, hereby incorporated herein by reference and the like.

Some suitable surface active agents which can be used as coating aids and to improve sliding properties and the like are disclosed, for example, in U.S. Pat. Nos. 3,294,540; 2,240,472; 2,831,766; 2,739,891; 2,359,980; 2,409,930; 2,447,750; 3,726,683; 2,823,123; and 3,415,649, hereby incorporated herein by reference and the like.

Photographic emulsions can also be spectrally sensitized with any suitable dyes including methine dyes and the like. Other suitable sensitizing dyes are disclosed, for example, in U.S. Pat. Nos. 2,231,658; 2,493,748; 2,503,776; 2,519,001; 2,912,329; 3,656,959; 3,694,217; 3,837,862; 3,814,609; 3,769,301; and 3,703,377, hereby incorporated herein by reference including combinations, particularly for supersensitization. The emulsion can also contain a dye having no spectral sensitizing action itself, or a material which does not absorb visible rays but which is capable of supersensitization.

Any suitable lubricating agents can be used including higher alcohol esters of higher fatty acids casein, higher fatty acid calcium salts, silicone compounds, liquid paraffin and the like as described in U.S. Pat. Nos. 2,588,756; 3,121,060; 3,295,979; 3,042,522 and 3,489,567, hereby incorporated herein by reference and the like.

Any suitable plasticizer can be used such as glycerin, diols, trihydric aliphatic alcohols and the like particularly as described in U.S. Pat. Nos. 2,960,404 and 3,520,694, hereby incorporated herein by reference and the like.

Matting agents and antifoggants known in the art can be used including those disclosed in U.S. Pat. Nos. 2,322,037; 3,079,257; 3,022,169; 2,336,327; 2,360,290; 2,403,721; 2,728,659; 2,732,300; 2,735,765; 2,418,613; 2,675,314; 2,710,801; 2,816,028; 3,457,079; and 2,384,658, hereby incorporated herein by reference and the like.

Any ultraviolet light-absorbing agents such as the compounds of the benzophenone series, the benzotriazole series, the thiazolidine series and the like can be used. Any brightening agents can be used including agents of the stilbene series, the triazine series, the oxazole series, the coumarin series and the like.

Thermally processable imaging elements include those having a support, a thermographic and photothermographic imaging layer on one side of the support, a backing layer, which is an outermost layer on the side opposite the imaging layer and an antistat layer in accordance with this invention which may be located on either side of the support. Numerous layer arrangements are defined in copending U.S. application Ser. No. 08/071,806, filed Jun. 2, 1993 entitled "Thermally Processable Imaging Element Comprising an Electroconductive Layer And A Backing Layer", assigned to the same assignee as the immediate application, which is entirely incorporated herein by reference.

The present invention is further illustrated by the following examples. Table I gives the compositions of the polyesterionomers used in the examples. These polymers are prepared in melt phase polymerization techniques well known in the art. The polymers are dispersed in hot water to give dispersions comprising 30 weight % solids. The vinylidene chloride terpolymer latex binder (polymer P-3) described in the prior art is made using conventional emulsion polymerization techniques.

TABLE I

| Polymer | Composition | Tg |
|---|---|---|
| P-1 | isophthalic acid (89 mol %), 5-sodiosulfoisophthalic acid (11 mol %), diethylene glycol (100 mol %) | 29 |
| P-2 | isophthalic acid (82 mol %), 5-sodiosulfoisophthalic acid (18 mol %), diethylene glycol (54 mol %), 1,4-cyclohexanedimethanol (46 mol %) | 55 |
| P-3 (control) | vinylidene chloride (79 mol %), acrylonitrile (15 mol %), acrylic acid (6 mol %) | 43 |

EXAMPLES 1-8

Aqueous antistatic formulations comprising 0 016 weight % silver-doped vanadium pentoxide, 0.02 weight % polymer binder, and various amounts of a nonionic surfactant (Olin 10 G, Olin Mathieson Chemical Co.) are made and allowed to age for 4 hours at room temperature. The solutions are filtered in a pressurized (to 2 lbs/in$^2$ with air) stainless steel filtration apparatus through a 47 mm diameter polypropylene filter. The solutions are first filtered through a 40 μm filter and then refiltered through a 15 μm filter. The time required to filter 450 g of solution is measured. Since all solutions filtered through the 40 μm filter in less than 15 seconds, only the results for the 15 μm filter are shown in Table 2. Samples A, B, and C contained only the polymer binder and 0.01% Olin 10 G surfactant and serve to illustrate that the binder dispersions themselves filter essentially identically. Samples D, E, and F are nonaged formulations that comprise the silver-doped vanadium pentoxide, polymer binder, and 0.01% 10G surfactant and serve to demonstrate that formulations comprising the different binders filter essentially identically when the solutions are fresh. However, as can be seen by the results, the formulations of the present invention featuring the polyesterionomer binders give superior filterability upon aging, indicating superior stability.

TABLE 2

| Sample | Binder Polymer | % 10G Surfactants | Filtration Time, sec |
|---|---|---|---|
| A* | P-1 | 0.010 | 11 |
| B* | P-2 | 0.010 | 11 |
| C* | P-3 | 0.010 | 12 |
| D** | P-1 | 0.010 | 14 |
| E** | P-2 | 0.010 | 13 |
| F** | P-3 | 0.010 | 15 |
| Comparative C1 | P-3 | 0.000 | 767 |
| Comparative C2 | P-3 | 0.005 | 251 |
| Comparative C3 | P-3 | 0.010 | 166 |
| Comparative C4 | P-3 | 0.015 | 300*** |
| Example 1 | P-1 | 0.000 | 50 |
| Example 2 | P-1 | 0.005 | 17 |
| Example 3 | P-1 | 0.010 | 124 |
| Example 4 | P-1 | 0.015 | 76 |
| Example 5 | P-2 | 0.000 | 63 |
| Example 6 | P-2 | 0.005 | 33 |
| Example 7 | P-2 | 0.010 | 39 |
| Example 8 | P-2 | 0.015 | 41 |

*These solutions only contain polymer binder and surfactant, no $V_2O_5$.
**Non-aged solutions containing polymer binder and $V_2O_5$.
***Only 400 g solution filtered before filter plugged.

EXAMPLES 9-10

Solutions are prepared as before and allowed to age at room temperature for 4 hours prior to filtration. The solutions are first filtered through a 40 μm filter. Each solution is then filtered through a 15 μm filter until the filter plugged and the quantity of solution filtered is recorded, the results are shown in Table 3.

TABLE 3

| Sample | Binder Polymer | % 10G Surfactant | gms Solution Filtered |
|---|---|---|---|
| Comparative C5 | P-3 | 0.010 | 360 |
| Comparative C6 | P-3 | 0.015 | 440 |
| Example 9 | P-2 | 0.010 | 580 |
| Example 10 | P-2 | 0.015 | 780 |

The polyesterionomer binders provided formulations with improved filterability compared to the binder polymer of the prior art.

EXAMPLE 11

An antistatic coating formulation as described in Example 2 is prepared and aged at room temperature. Aliquots of the solution are taken after aging for 0, 4, 24, and 48 hrs. at room temperature. Each aliquot is filtered through a 15 μm filter and then coated with a doctor blade onto polyethylene terephthalate film support that had been subbed with a terpolymer latex of acrylonitrile, vinylidene chloride, and acrylic acid. The coating is dried 2 minutes at 100° C. to give an antistatic layer with a dry weight of about 12 milligrams per square meter. The surface resistivity for the coatings is measured at 30% relative humidity using a two-point probe. The results, which are given in Table 4, show that formulations of the invention have excellent conductivity even after 48 hours aging.

TABLE 4

| Solution Age, hours | Surface Resistivity, ohm/sq |
|---|---|
| 0 | $6.3 \times 10^6$ |
| 4 | $6.3 \times 10^6$ |
| 24 | $1.6 \times 10^7$ |
| 48 | $2.0 \times 10^7$ |

EXAMPLE 12

A coating formulation comprising 0.023 weight % silver-doped vanadium pentoxide, 0.028 weight % polymer P-2, and 0.02 weight % Olin 10 G wetting aid, is applied onto a moving web of polyethylene terephthalate film support that is subbed with a terpolymer latex of acrylonitrile, vinylidene chloride, and acrylic acid. The coating is dried at about 120° C. to give an antistatic layer with a dry weight of about 12 milligrams per square meter. A comparative antistatic layer is prepared in a similar manner using polymer P-3 as the binder. Both antistatic layers are then overcoated with a 1 μm thick cellulose diacetate protective overcoat. The internal resistivity for the samples after overcoating is measured using the salt bridge method. Sample dry adhesion is checked by scribing small hatch marks in the coating with a razor blade, placing a piece of high tack tape over the scribed area and then quickly pulling the tape from the surface. The amount of the scribed area removed is a measure of the dry adhesion. Wet adhesion is tested by placing the test sample in developing and fixing solutions at 35° C. for 30 seconds each and then rinsing in distilled water. While still wet, a one millimeter wide line is scribed in the protective overcoat and a finger is rubbed vigorously across the scribe line. The width of the line after rubbing is compared to that before rubbing to give a measure of wet adhesion. The results for the two samples are compared in Table 5.

TABLE 5

| Sample | Binder | Internal Resistivity ohm/sq | Dry Adhesion | Wet Adhesion |
|---|---|---|---|---|
| Comparative C-7 | P-3 | $2.0 \times 10^7$ | Poor | Poor |
| Example 12 | P-2 | $1.3 \times 10^7$ | Excellent | Excellent |

As shown by the data in Table 5 the antistatic coatings of the invention provide improved adherence to underlying and overlying layers.

The invention has been described in detail with particular reference to preferred embodiments, but it will be understood that variations and modifications can be effected within the spirit and scope of the invention.

What is claimed is:

1. An imaging element comprising a support, at least one imaging layer and an antistat layer, said antistat layer comprising vanadium pentoxide in a binder, said binder being a polyesteranionomer.

2. The element of claim 1 wherein the polyesteranionomer contains carboxyl groups, alkali metal carboxylate groups, sulfonic acid groups or alkali metal sulfonate groups.

3. The element of claim 2 wherein the polyesteranionomer contains alkali metal sulfonate groups.

4. The element of claim 3 wherein the alkali metal is sodium.

5. The element of claim 1 wherein polyesteranionomer is the reaction product of a nonionic dicarboxylic acid, a glycol and 5-sodiosulfoisophthalic acid.

6. The element of claim 1 wherein the vanadium pentoxide is silver doped.

7. The imaging element of claim 1 wherein the polyesteranionomer is the reaction product of a dicarboxylic acid, a glycol and from about 1 to 25 mol percent based on the total mols of dicarboxylic acid present of a dibasic acid containing an anion moiety.

8. The imaging element of claim 1 wherein the imaging layer is a light-sensitive silver halide layer.

9. The imaging element of claim 1 wherein the imaging layer is the light-sensitive layer is a thermographic or photothermographic layer.

* * * * *